US011560536B2

(12) United States Patent
Martin et al.

(10) Patent No.: US 11,560,536 B2
(45) **Date of Patent: *Jan. 24, 2023**

(54) AEROSOL CLEANING COMPOSITION

(71) Applicant: Illinois Tool Works Inc., Glenview, IL (US)

(72) Inventors: William C. Martin, Hawthorne, NJ (US); Pierce A. Pillon, Amarillo, TX (US); Mercedita S. Whitmire, Villa Rica, GA (US); Eric J. Martini, Smyrna, GA (US); Matthew E. Morris, Kennesaw, GA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/152,452

(22) Filed: Jan. 19, 2021

(65) Prior Publication Data

US 2021/0139820 A1 May 13, 2021

Related U.S. Application Data

(62) Division of application No. 15/881,298, filed on Jan. 26, 2018, now Pat. No. 10,920,181.

(60) Provisional application No. 62/500,863, filed on May 3, 2017.

(51) Int. Cl.

| | |
|---|---|
| ***C11D 3/00*** | (2006.01) |
| ***C11D 17/00*** | (2006.01) |
| ***C11D 3/43*** | (2006.01) |
| ***C11D 3/24*** | (2006.01) |
| ***C11D 7/30*** | (2006.01) |
| ***C11D 7/50*** | (2006.01) |

(52) U.S. Cl.

CPC ..... *C11D 17/0043* (2013.01); *C11D 3/24* (2013.01); *C11D 3/245* (2013.01); *C11D 3/43* (2013.01); *C11D 7/30* (2013.01); *C11D 7/5018* (2013.01)

(58) Field of Classification Search

CPC ..... C07C 21/18; C07C 17/383; C11D 7/5018; C11D 17/0043; C11D 3/24; C11D 3/245; C11D 3/43; C11D 7/30; C11D 7/505; C09K 2205/122; C09K 3/30; C09K 5/045

See application file for complete search history.

(56) References Cited

U.S. PATENT DOCUMENTS

| | | | | |
|---|---|---|---|---|
| 10,920,181 | B2 * | 2/2021 | Martin | C11D 3/245 |
| 2003/0141481 | A1 * | 7/2003 | Hitters | C08J 9/149 252/67 |
| 2003/0224956 | A1 | 12/2003 | Miller et al. | |
| 2010/0029531 | A1 | 2/2010 | Marhold et al. | |

FOREIGN PATENT DOCUMENTS

| | | | |
|---|---|---|---|
| JP | 2007531812 | A | 11/2007 |
| JP | 2009528433 | A | 8/2009 |
| JP | 2013504658 | A | 2/2013 |

* cited by examiner

*Primary Examiner* — John R Hardee

(74) *Attorney, Agent, or Firm* — McAndrews, Held & Malloy, Ltd.

(57) ABSTRACT

A nonflammable aerosol cleaning composition is formulated with trans 1,2 dichloroethylene, 1,1,1,2,2,3,4,5,5,5-decafluoropentane, 1,1,1,3,3 pentafluoropropane, HFC-134a, and carbon dioxide. The aerosol cleaning composition is formulated for heavy duty, high pressure, and high output cleaning applications for cleaning aviation parts, such as jet engines located about 10 feet away from a user.

9 Claims, No Drawings

AEROSOL CLEANING COMPOSITION

This application is a divisional of U.S. patent application Ser. No. 15/881,298, now U.S. Pat. No. 10,920,181, filed Jan. 26, 2018, titled, Aerosol Cleaning Composition, which claims the benefit of and priority to Provisional U.S. Patent Application Ser. No. 62/500,863, filed May 3, 2017, titled, Aerosol Cleaning Composition, the entireties of which are incorporated fully herein by reference.

CROSS-REFERENCE TO RELATED APPLICATION DATA

This application claims the benefit of and priority to Provisional U.S. Patent Application Ser. No. 62/500,863, titled, AEROSOL CLEANING COMPOSITION, filed May 3, 2017, the disclosure of which is incorporated herein in its entirety.

BACKGROUND

The present disclosure relates to cleaning compositions, and more particularly to aerosol cleaning compositions for heavy duty cleaning of aircraft assemblies.

Aircraft assemblies, such as jet engines, are exposed to and thus accumulate hydraulic fluids, pneumatic lubricants, combustion by-products and other types of contaminations. Such accumulations may be cleaned and/or degreased with cleaning compositions. For example, aerosol cleaning compositions may be used to clean jet engine surfaces when a cowl is lifted. However, most conventional aerosol cleaning compositions do not provide sufficient force or output to reach up to the cold section of a jet engine, which may be up to 10 feet away from a user.

Further, many conventional aerosol jet cleaning compositions may contain toxic solvents, such as n-propyl bromide, and may also be flammable or combustible. Flammability of aerosol compositions may be mitigated with an appropriate combination of solvent(s) and propellant(s). However, the flammability of an aerosol composition typically increases with increase in aerosol output pressure. Thus, controlling flammability becomes more challenging for high pressure and high output aerosol compositions.

There remains a need, therefore, for improved high pressure, high output aerosol cleaning compositions for cleaning aircraft assemblies.

BRIEF SUMMARY

High pressure, high output, nonflammable aerosol cleaning compositions for cleaning and degreasing aircraft assemblies are provided according to various embodiments. The aerosol cleaning compositions may be formulated to provide sufficient output pressure to reach and clean a target located about 10 feet vertically above a user when provided in an aerosol assembly including a high output aerosol valve and nozzle. Further, the aerosol cleaning compositions may be formulated to effectively clean and degrease hydraulic fluids, pneumatic lubricants, and combustion by-products on aircraft assemblies, such as a jet engine.

In one aspect, a nonflammable aerosol cleaning composition may comprise trans 1,2-dichloroethylene, 1,1,1,2,2,3,4,5,5,5-decafluoropentane, 1,1,1,3,3-pentafluoropropane; and a blend of propellants including 1,1,1,2-tetrafluoroethane (HFC-134a) and carbon dioxide.

In some embodiments, trans 1,2-dichloroethylene may be present in a concentration of at about 55% to about 70% by weight of the cleaning composition (w/w). 1,1,1,2,2,3,4,5,5,5-decafluoropentane may be present in a concentration of at about 10% to about 20% w/w, and 1,1,1,3,3 pentafluoropropane may be present in a concentration of at about 5% to about 15% w/w. Further, HFC-134a may be present in a concentration of at about 5% to about 15% w/w, and carbon dioxide is present in a concentration of at about 2% to about 7% w/w.

In another aspect, a nonflammable aerosol cleaning composition may comprise a blend of solvents comprising 1,1,1,3,3-pentafluoropropane and at least one other hydrofluorocarbon solvent or trans 1,2-dichloroethylene solvent, and a blend of propellant comprising HFC-134a and carbon dioxide. The nonflammable aerosol cleaning composition may be configured for cleaning a target located at about 10 feet away when provided in a high output wasp and hornet aerosol spray type can.

In an embodiment, the blend of solvents may comprise trans 1,2-dichloroethylene, 1,1,1,2,2,3,4,5,5,5-decafluoropentane, and 1,1,1,3,3-pentafluoropropane.

For example, the nonflammable aerosol cleaning composition may comprise trans 1,2-dichloroethylene in a concentration of about 55% to about 70% w/w, 1,1,1,2,2,3,4,5,5,5-decafluoropentane in a concentration of about 10% to about 20% w/w, 1,1,1,3,3-pentafluoropropane in a concentration of about 5% to about 15% w/w, HFC-134a in a concentration of about 5% to about 15% w/w, and carbon dioxide in a concentration of about 2% to about 7% w/w. In some embodiments, a sum of the concentrations of the trans 1,2-dichloroethylene, 1,1,1,2,2,3,4,5,5,5-decafluoropentane, 1,1,1,3,3-pentafluoropropane, HFC-134a, and carbon dioxide may be about 100% w/w of the weight of the nonflammable aerosol cleaning composition.

In any of the foregoing embodiments, the aerosol cleaning composition may be classified as nonflammable when tested according to the flame ignition distance test and the enclosed space ignition test per the test methodology outlined in UN2009, Section 31. Further, the aerosol cleaning composition may be configured to conform to the criteria in sections 4.1.1 Appearance, 4.1.2 Odour, 4.1.3 Flash Point, 4.1.4 Residue on Evaporation, and 4.1.7 Freedom from Corrosive Action of Airbus UK ABR 9-0140 General Purpose Cleaning Solvent (Amendment Notice Issue 5 [11 Nov. 2009] to ABR 9-0140 at Issue 6 [February 2000]). The nonflammable aerosol cleaning composition may also be configured to conform to the criteria in Sandwich Corrosion Test, Paint Softening Test, Hydrogen Embrittlement Test, and Stress Corrosion Cracking Test of Boeing D6 17487, Revision T.

Other aspects, objectives and advantages will become more apparent from the following detailed description when taken in conjunction with the accompanying drawings.

DETAILED DESCRIPTION

While the present disclosure is susceptible of embodiment in various forms, there is shown in the drawings and will hereinafter be described presently preferred embodiments with the understanding that the present disclosure is to be considered an exemplification and is not intended to limit the disclosure to the specific embodiments illustrated.

An aerosol cleaning composition for cleaning and degreasing aircraft assemblies is provided according to various embodiments. The aerosol cleansing composition may be formulated as a nonflammable composition that can effectively dissolve and remove hydraulic fluids, pneumatic lubricants, combustion by-products, and other types of contamination deposits on aircraft assemblies, such as jet engine surfaces, without exposing a user to harmful solvent vapors, such as n-propyl bromide vapor.

Further, the aerosol cleaning composition may be formulated for a high pressure, high output aerosol system. In such embodiments, the aerosol cleaning composition may be formulated with at least one solvent and a blend of propellants and provided in an aerosol assembly including a high output aerosol valve and nozzle to provide a high pressure, high output aerosol system for spraying and cleaning a target located about 10 feet away from a user. The high pressure, high output aerosol system containing the aerosol cleaning composition according to various embodiments of the present disclosure may be used by a user to spray and clean aircraft assemblies, such as a cold section of a jet engine, which may be located about 10 feet vertically above the user.

According to an embodiment, an aerosol cleaning composition may be formulated with a blend of solvents and/or cleaning agents, and at least one propellant. Suitable solvents and cleaning agents may include hydrofluorocarbon, such as 1,1,1,2,2,3,4,5,5,5-decafluoropentane, 1,1,1,3,3 pentafluoropropane, hydrofluoroethers, such as methoxynonafluorobutane (HFE-7100), hydrofluoroolefins, such as trans-1-chloro-3,3,3-trifluoropropene, and dichloroethylene, such as trans 1,2 dichloroethylene. Suitable propellants may include hydrofluorocarbon (HFC) liquefied gas, such as 1,1,1,2-tetrafluoroethane (HFC-134a), hydrofluoroolefin (HFO) gas, such as trans-1,3,3,3-tetrafluoroprop-1-ene (HFO1234ze) and 2,3,3,3-tetrafluoroprop-1-ene (HFO1234yf), and carbon dioxide.

Some properties of the aerosol cleaning composition, such as flammability and ability to propel the cleaning composition spraying from an aerosol assembly, may change rapidly with selection of each component and quantity thereof. Therefore, significant time and effort have been invested by the Applicant of the present application in formulating the aerosol cleaning composition that is nonflammable, high pressure, high output, and can clean tough contaminants, such as hydraulic fluids, pneumatic lubricants, and combustion by-products, from aircraft assemblies.

In an embodiment, the aerosol cleaning composition may be formulated with a blend of propellants to continuously propel the cleaning composition with high pressure and high output from a high output aerosol assembly to clean a target located up to 10 feet away. In such an embodiment the cleaning composition may be provided in an aerosol can assembly including a high output valve and nozzle, such as an aerosol system assembly designed for wasp and hornet spray elimination.

In some embodiments, the aerosol cleaning composition may be formulated with at least two different propellants. For example, the aerosol composition may be formulated with a dual propellant system including a hydrofluorocarbon (HFC) liquefied gas and carbon dioxide. In an embodiment, the aerosol cleaning composition may comprise about 3.0 percent (%) to about 20.0% by weight (w/w) of HFC-134a, preferably about 4.0% to about 17.0% w/w, and more preferably about 5.0% to about 15.0% w/w, and about 1.0% to about 9.0% w/w of carbon dioxide, preferably about 2.0% to about 7.0% w/w, and more preferably about 3.0% to about 6% w/w.

Due to the high pressure, high output, and nonflammability requirements, propellant and solvent options for the aerosol cleaning composition are narrow. For example, trans-1,3,3,3-tetrafluoroprop-1-ene (HFO-1234ze) was unsuccessful as a nonflammable propellant, and methoxynonafluorobutane (HFE-7100) was only marginally successful in providing the required high pressure, high output nonflammable aerosol solvent in the cleaning system.

Further, the high pressure and high output requirement of the aerosol cleaning system makes it more difficult to mitigate flammability of the aerosol cleaning composition. Some blends of propellants and solvents provided the required spray output pressure and contaminant solvency, but rendered the composition flammable. Some blends provided a nonflammable aerosol cleaning composition having the required contaminant solvency, but did not provide the required spray output pressure. It was surprisingly discovered that formulating an aerosol cleaning composition with an appropriate synergistic combination of propellants and solvents including 1,1,1,3,3-pentafluoropropane in a specific quantity can effectively reduce flammability of the aerosol cleaning composition while still providing the required high pressure, high output aerosol system.

In an embodiment, the aerosol cleaning composition may be formulated with a blend of trans 1,2-dichloroethylene, 1,1,1,2,2,3,4,5,5,5-decafluoropentane, and 1,1,1,3,3-pentafluoropropane. The quantities of trans 1,2-dichloroethylene and 1,1,1,2,2,3,4,5,5,5-decafluoropentane may be formulated to increase the solvency of hydraulic fluids, combustion byproducts, and other contaminants. The aerosol cleaning composition may be formulated with about 50% to about 75% w/w of trans 1,2-dichloroethylene, preferably about 55% to about 70% w/w, and more preferably about 60% to about 68% w/w, and about 5% to about 25% w/w of 1,1,1,2,2,3,4,5,5,5-decafluoropentane, preferably about 10% to about 20% w/w, and more preferably about 12% to about 18% w/w, and about 3% to about 20% w/w of 1,1,1,3,3-pentafluoropropane, preferably about 5% to about 15% w/w, and more preferably about 7% to about 13% w/w.

In an embodiment, an aerosol cleaning composition may comprise about 55% to about 70% w/w of trans 1,2-dichloroethylene, about 10% to about 20% w/w of 1,1,1,2,2,3,4,5,5,5-decafluoropentane, and about 5% to about 15% w/w of 1,1,1,3,3-pentafluoropropane, about 5% to about 15% w/w of HFC 134a, and about 2% to about 7% of carbon dioxide. In some embodiments, the aerosol cleaning composition may be formulated such that the percentage by weight of trans 1,2-dichloroethylene, 1,1,1,2,2,3,4,5,5,5-decafluoropentane, 1,1,1,3,3-pentafluoropropane, HFC 134a, and carbon dioxide add up to about 100% by weight of the aerosol, cleaning composition.

Samples of an aerosol cleaning composition comprising about 55% to about 70% w/w of trans 1,2-dichloroethylene, about 10% to about 20% w/w of 1,1,1,2,2,3,4,5,5,5-decafluoropentane, about 5% to about 15% w/w of 1,1,1,3,3-pentafluoropropane, about 5% to about 15% w/w of HFC 134a, and about 2% to about 7% of carbon dioxide were prepared and tested. The sample compositions effectively removed hydraulic and lubricating fluids, and dried fast leaving no residue. The solvent phase of the sample compositions were evaluated under the Globally Harmonized System (GHS) Flammable (and Combustible) Liquids criteria and categorized as nonflammable. Further, the sample compositions were compatible with high density polyethylene (HDPE), low density polyethylene (LDPE), Nylon 6, Nylon 6/6, Phenolic CE, polypropylene, polyoxymethylene (POM), polyvinyl chloride (PVC), and polytetrafluoroethylene, e.g. Teflon.

The sample compositions were evaluated according to Airbus UK ABR 9-0140 General Purpose Cleaning Solvent (Amendment Notice Issue 5 [11 Nov. 2009] to ABR 9-0140 at Issue 6 [February 2000]), and were determined as conforming to sections 4.1.1-4.1.4, and 4.1.7:

4.1.1 Appearance: The cleaning solvent shall be a single phase liquid, consisting of a single solvent or completely miscible mixture of solvents free from sediments and suspended solids. Result_Conforms_

4.1.2 Odour: The cleaning solvent shall not produce unpleasant odours either during or after application. Result_Conforms_

4.1.3 Flash Point: ASTM D93: No flash point observed at 33° C. (91° F.)

Result_Conforms_

4.1.4 Residue on Evaporation: The residue on evaporation shall be expressed as the percentage weight remaining after 50 ml of the solvent have been evaporated to dryness of a water bath and then heated at 110±2° C. in an oven to constant weight. The weight of residue shall be determined immediately after cooling to room temperature in an efficient desiccator.

Residue on Evaporation: less than 5 mg per 50 ml of liquid Result_Conforms_

4.1.7 Freedom from Corrosive Action: Unused panels of the following metals each 75 mm×25 mm×0.91 mm pretreated or plated on faces and edges as describe, shall be degreased by the method described in ABP-1294, dried at 100±2° C. for 2 hour, cooled and weighed to 0.0001 g. The panels shall then be completely immersed in the cleaning solvent, separately, in stoppered containers at room temperature for 168 hours. On completion of the immersion period the panels shall be removed from the cleaning solvent and rinsed thoroughly under running cold water, the surfaces being gently swabbed with cotton wool. They shall be rinsed in distilled water followed by a mixture of equal volumes of methylated spirit and acetone, dried at 100-105° C. for 2 hours, cooled and weighed to 0.0001 g. No attempt shall be made to remove any corrosion products from the panels before weighing. The panels shall finally be examined visually. The metal panels shall not increase in weight by more than 1 mg and shall not decrease in weight by more than 5 mg. The metal panels shall not show pitting of the edges or surfaces, formation of adherent deposits or other signs of corrosion.

| | Allowed/1" × 3" panel | | Results |
|---|---|---|---|
| Alloy | Increase | Decrease | (mg/panels) |
| Aluminum - AMS 4037 bare aluminum anodized per MIL-A-8625 Type I | 1 mg | 5 mg | +0.7 mg |
| Magnesium - AMS 4376 bare AZ-31B-H26, no chromate film | | | +0.1 mg |
| Copper - AMS 4500 Copper (ASTM B152-99.9% Cu) | | | +0.1 mg |
| Steel - AMS 5045 (1020 alloy) | | | +0.7 mg |
| Cadmium plated steel - AMS 5045, Bright Cadmium plated per MIL-STD-870, Type 2, Class 1 (with chromate seal) | | | +0.3 mg |

Visual observation: No pitting, adherent deposits or other signs of corrosion

Result_Conforms_

Further, the sample compositions were evaluated according to Boeing D6 17487, Revision T, Solvent Cleaners; General Cleaning:

Sandwich Corrosion Test:

| | Bare 7075-T6 (AMS 4045) Anodized Per BAC 5019 (Type 3 chromate seal) | Clad 7075-T6 Aluminum (AMS 4049) |
|---|---|---|
| Product | 1 | 1 |
| Control | 1 | 1 |

Result_Conforms_

Paint Softening Test:

Paint system 1: 0 pencil hardness change after 24 hour post-exposure dry time.

No discoloration or staining.

Paint system 2: 0 pencil hardness change after 24 hour post-exposure dry time.

No discoloration or staining.

Result_Conforms_

Hydrogen Embrittlement Test:

Specimens: Type 1c, cadmium plated per MIL-STD-870. (45% load, 150 hours, notched immersed for the duration, room temperature.)

#1: No failure occurred within 150 hours.

#2: No failure occurred within 150 hours.

#3: No failure occurred within 150 hours.

#4: No failure occurred within 150 hours.

Result_Conforms_

Stress Corrosion Cracking: Method A used for testing

Product: AMS 4911: #1—No cracking evident

#2—No cracking evident

#3—No cracking evident

AMS 4916: #1—No cracking evident

#2—No cracking evident

#3—No cracking evident

Result_Conforms_

The sample compositions were also evaluated for their cleaning performance under MIL-PRF-29608C, 2 Nov. 2016, Cleaning and Cleaning-Lubricating Compounds, Electrical Contact, 4.5.7 Cleaning Efficiency.

Soil Removal (% Efficiency/Soil Removal)

| | |
|---|---|
| Lubrizol Corrosion Inhibitor | 100% |
| Unilube All Purpose Grease | 100% |
| 5W30 Synthetic Oil | 100% |
| Fire resistant hydraulic fluid | 100% |
| Chain lubricant | 100% |
| Silicone | 100% |

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular. All percentages, whether specified of not, are percentages by weight.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A nonflammable aerosol cleaning composition, comprising:

a blend of solvents comprising 1,1,1,3,3-pentafluoropropane, trans 1,2-dichloroethylene, and 1,1,1,2,2,3,4,5,5,5-decafluoropentane, and a blend of propellants comprising HFC-134a and carbon dioxide, wherein the aerosol cleaning composition is configured for cleaning a target located about 10 feet away from a user when provided in a high output wasp and hornet aerosol spray type can.

2. The nonflammable aerosol cleaning composition of claim 1, wherein the nonflammable aerosol cleaning composition comprises trans 1,2-dichloroethylene in a concentration of about 55% to about 70% w/w, 1,1,1,2,2,3,4,5,5,5-decafluoropentane in a concentration of about 10% to about 20% w/w, 1,1,1,3,3-pentafluoropropane in a concentration of about 5% to about 15% w/w, HFC-134a in a concentration of about 5% to about 15% w/w, and carbon dioxide in a concentration of about 2% to about 7% w/w.

3. The nonflammable aerosol cleaning composition of claim 2, wherein a sum of the concentrations of the trans 1,2-dichloroethylene, 1,1,1,2,2,3,4,5,5,5-decafluoropentane, 1,1,1,3,3-pentafluoropropane, HFC-134a, and carbon dioxide is about 100% w/w of the weight of the nonflammable aerosol cleaning composition.

4. The nonflammable aerosol cleaning composition of claim 1, wherein the nonflammable aerosol cleaning composition has no flash point when tested according to 31.4 Ignition Distance Test for Spray Aerosols and 31.5 Enclosed Space Ignition Test of GHS Aerosol Flammability (2009).

5. The nonflammable aerosol cleaning composition of claim 1, wherein the aerosol cleaning composition is configured to conform to the criteria in sections 4.1.1 Appearance, 4.1.2 Odour, 4.1.3 Flash Point, 4.1.4 Residue on Evaporation, and 4.1.7 Freedom form Corrosive Action of Airbus UK ABR 9-0140 General Purpose Cleaning Solvent (Amendment Notice Issue 5 [11 Nov. 2009] to ABR 9-0140 at Issue 6 [February 2000]).

6. The nonflammable aerosol cleaning composition of claim 1, wherein the aerosol cleaning composition is configured to conform to the criteria in Sandwich Corrosion Test, Paint Softening Test, Hydrogen Embrittlement Test, and Stress Corrosion Cracking Test of Boeing D6 17487, Revision T.

7. The nonflammable aerosol cleaning composition of claim 1, wherein the 1,1,1,3,3 pentafluoropropane is present in a concentration of about 5% to about 15% w/w.

8. The nonflammable aerosol cleaning composition of claim 1, wherein the HFC-134a is present in a concentration of about 5% to about 15% w/w.

9. The nonflammable aerosol cleaning composition of claim 1, wherein the carbon dioxide is present in a concentration of about 2% to about 7% w/w.

* * * * *